US007930998B2

(12) United States Patent
Cottell

(10) Patent No.: US 7,930,998 B2
(45) Date of Patent: Apr. 26, 2011

(54) REAL TIME IN-LINE WATER-IN-FUEL EMULSION APPARATUS, PROCESS AND SYSTEM

(76) Inventor: Eric William Cottell, Nassau (BS)

( * ) Notice: Subject to any disclaimer, the term of this patent is extended or adjusted under 35 U.S.C. 154(b) by 0 days.

(21) Appl. No.: 12/761,685

(22) Filed: Apr. 16, 2010

(65) Prior Publication Data

US 2010/0199939 A1 Aug. 12, 2010

Related U.S. Application Data

(63) Continuation-in-part of application No. 11/725,757, filed on Mar. 20, 2007.

(60) Provisional application No. 60/786,881, filed on Mar. 30, 2006.

(51) Int. Cl.
*F02B 43/00* (2006.01)

(52) U.S. Cl. ..... 123/1 A

(58) Field of Classification Search ..... 421/2–4, 421/190, 208, 280–282, 320, 301, 574, 576, 421/629; 123/25 R, 1 A, 25 C, 25 E, 515, 123/25 J, 198 A, 25 B, 568.12, 25 D, 73 AD, 123/196 A; 44/301, 442, 302, 324, 325, 44/415; 137/13, 15.05, 565.01, 624.14, 828
See application file for complete search history.

(56) References Cited

U.S. PATENT DOCUMENTS

| | | | | |
|---|---|---|---|---|
| 3,241,318 | A | 3/1966 | Rohde | |
| 3,941,552 | A | 3/1976 | Cottell | |
| 4,048,963 | A | 9/1977 | Cottell | |
| 4,167,919 | A * | 9/1979 | Woolley et al. | 123/1 A |
| 4,218,221 | A | 8/1980 | Cottell | |
| 4,388,893 | A * | 6/1983 | Apfel | 123/25 J |
| 4,687,491 | A | 8/1987 | Latty | |
| 4,938,606 | A | 7/1990 | Kunz | |
| 5,125,367 | A | 6/1992 | Ulrich et al. | |
| 5,380,089 | A | 1/1995 | Karasawa | |
| 5,542,379 | A * | 8/1996 | Kessler | 123/25 C |
| 6,659,365 | B2 | 12/2003 | Gipson et al. | |
| 6,840,290 | B2 | 1/2005 | Gregory et al. | |
| 6,949,235 | B2 | 9/2005 | Brown et al. | |
| 7,041,145 | B2 | 5/2006 | Ambrosini et al. | |
| 2004/0177547 | A1 * | 9/2004 | Anderson et al. | 44/302 |
| 2006/0105642 | A1 | 5/2006 | Ries et al. | |

OTHER PUBLICATIONS

Kanagawa University Press Release, Jul. 12, 2006, 5 pages (Applicant's Provisional Appl. pre-dates this reference).
Office Action issued by the USPTO on Sep. 15, 2010 in co-pending U.S. Appl. No. 11/725,757.

* cited by examiner

*Primary Examiner* — Michael Cuff
*Assistant Examiner* — Keith Coleman
(74) *Attorney, Agent, or Firm* — Goodman, Allen & Filetti, PLLC

(57) ABSTRACT

A water-in-fuel emulsion system comprises a reactor device, a fuel intake connected to said reactor device, a water intake connected to said reactor device, a pump connected to said reactor device, and a circulating emulsion reprocessing inline loop connected to said pump and feeding a load as needed in real time, wherein said reactor device comprises a non-vibrating anvil shaped to create cavitation sufficient to emulsify water-in-fuel from said water intake and said fuel intake.

16 Claims, 12 Drawing Sheets

Detail B

REAL TIME IN-LINE WATER-IN-FUEL EMULSION APPARATUS, PROCESS AND SYSTEM

CROSS-REFERENCE TO RELATED APPLICATIONS

This application is a Continuation-In-Part Application of U.S. patent application Ser. No. 11/725,757, filed Mar. 20, 2007, which claims priority to U.S. Provisional Application No. 60/786,881, filed Mar. 30, 2006. The disclosures of both applications are incorporated herein by reference.

BACKGROUND OF THE INVENTION

This invention relates in general to emulsion. More particularly the invention relates to fuels and related compositions. Most particularly, the invention relates to methods, apparatus and systems for producing a fuel emulsion.

Emulsion occurs when one liquid is suspended inside another liquid. Recent fuel developments have led to fuel emulsion, wherein water is suspended inside fuel. A number of water-in-fuel emulsions comprised essentially of a carbon based fuel, water, and various additives. These fuel emulsions may play a key role in finding a cost-effective way for internal combustion engines, boilers, furnaces and the like, to achieve greater efficiency and a reduction in emissions without producing significant modifications to the engines, fuel systems, or existing fuel delivery infrastructure.

SUMMARY OF THE INVENTION

This invention relates to real time in-line a water-in-fuel emulsion system comprising a reactor device, a fuel intake connected to said reactor device, a water intake connected to said reactor device, a pump connected to said reactor device, and a circulating emulsion reprocessing inline loop connected to said pump and feeding a load as needed in real time, wherein said reactor device comprises a non-vibrating anvil shaped to create cavitation sufficient to emulsify water-in-fuel from said water intake and said fuel intake.

Various advantages of this invention will become apparent to those skilled in the art from the following detailed description of the preferred embodiment, when read in light of the accompanying drawings.

BRIEF DESCRIPTION OF THE DRAWINGS

FIG. 8 is a diagram of a fuel-water emulsion system for small combustion devices.

DETAILED DESCRIPTION OF THE PREFERRED EMBODIMENT

Figure 1:
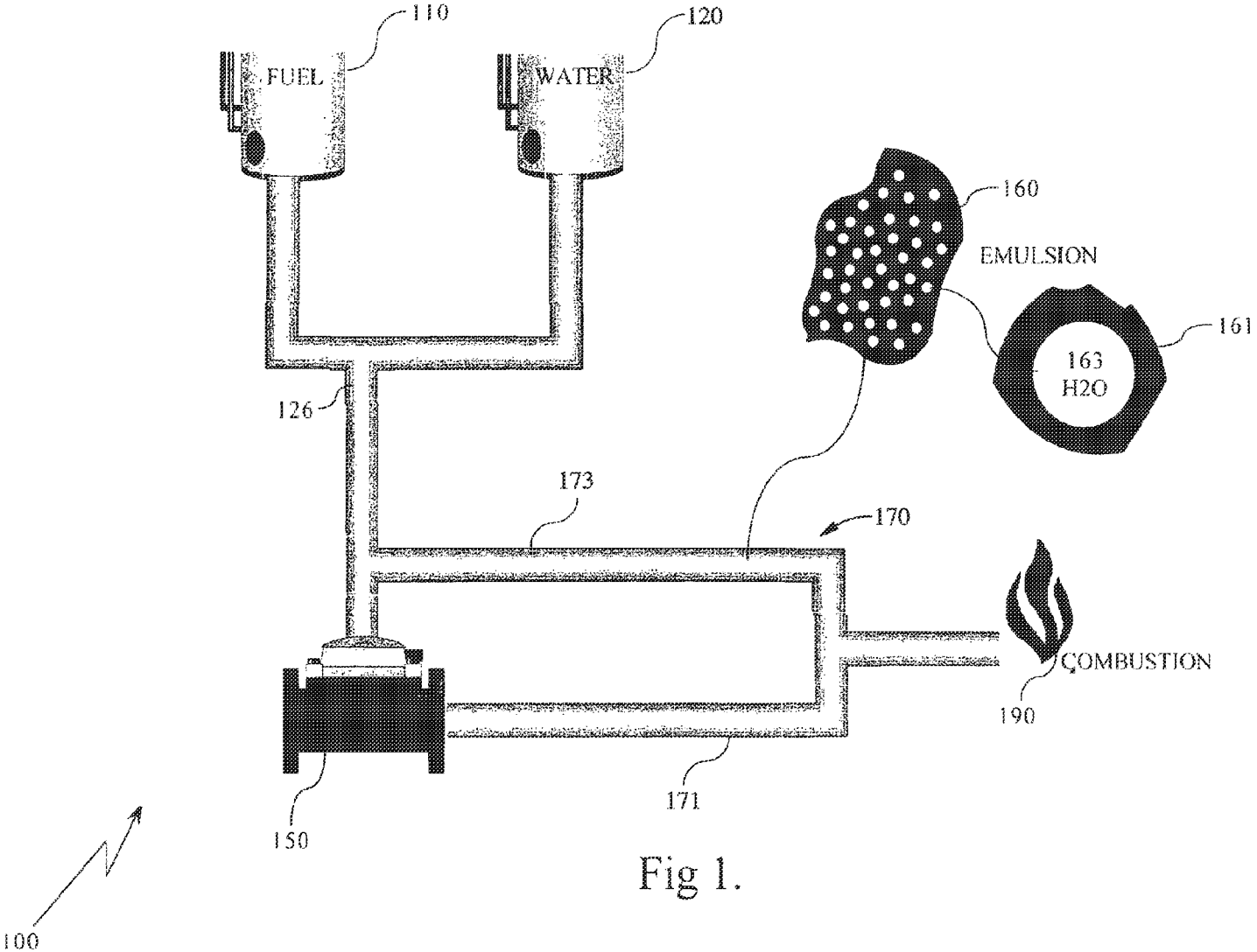
FIG. 1 is a diagram of a fuel-water emulsion system.

Referring now to the drawings, there is illustrated in FIG. 1 a block diagram of a system 100 for producing an intimate emulsion of water in oil at the point of combustion, wherein like numerals represent like parts throughout the several views. The system 100 may be in the form a real time in-line fuel-water emulsion system. Although the system may be in other forms, it may be in the form of a Hydrosonic system, wherein the flow of liquid creates cavitation and sound. The system 100 may be comprised of a fuel supply 110, a water supply 120, a fuel and water mixing junction 126, a reactor or emulsion apparatus 150, which may be near a point of combustion 190. In addition, the system 100 may comprise an emulsified fuel circulating loop 170, which may include a high pressure side 171, a valve or solenoid valve (not shown), and a low pressure side 173.

The system 100 may produce an emulsion 160 comprising oil 161 and water 163. In particular, an emulsified fuel 160 may be formed from water droplets 163 in fuel oil 162. The viscosity of the emulsified fuel 160 may be changed by introducing an atom, a molecule, or a particle at the center of the water droplets 163, so as to form a three layer emulsified fuel, wherein the atom, molecule, or particle is surrounded by water 163, which in turn is surrounded by fuel oil 162 to form a three layer emulsified fuel. For example, the introduction of a carbon atom may form a three layer hydrocarbon emulsified fuel.

Figure 2:
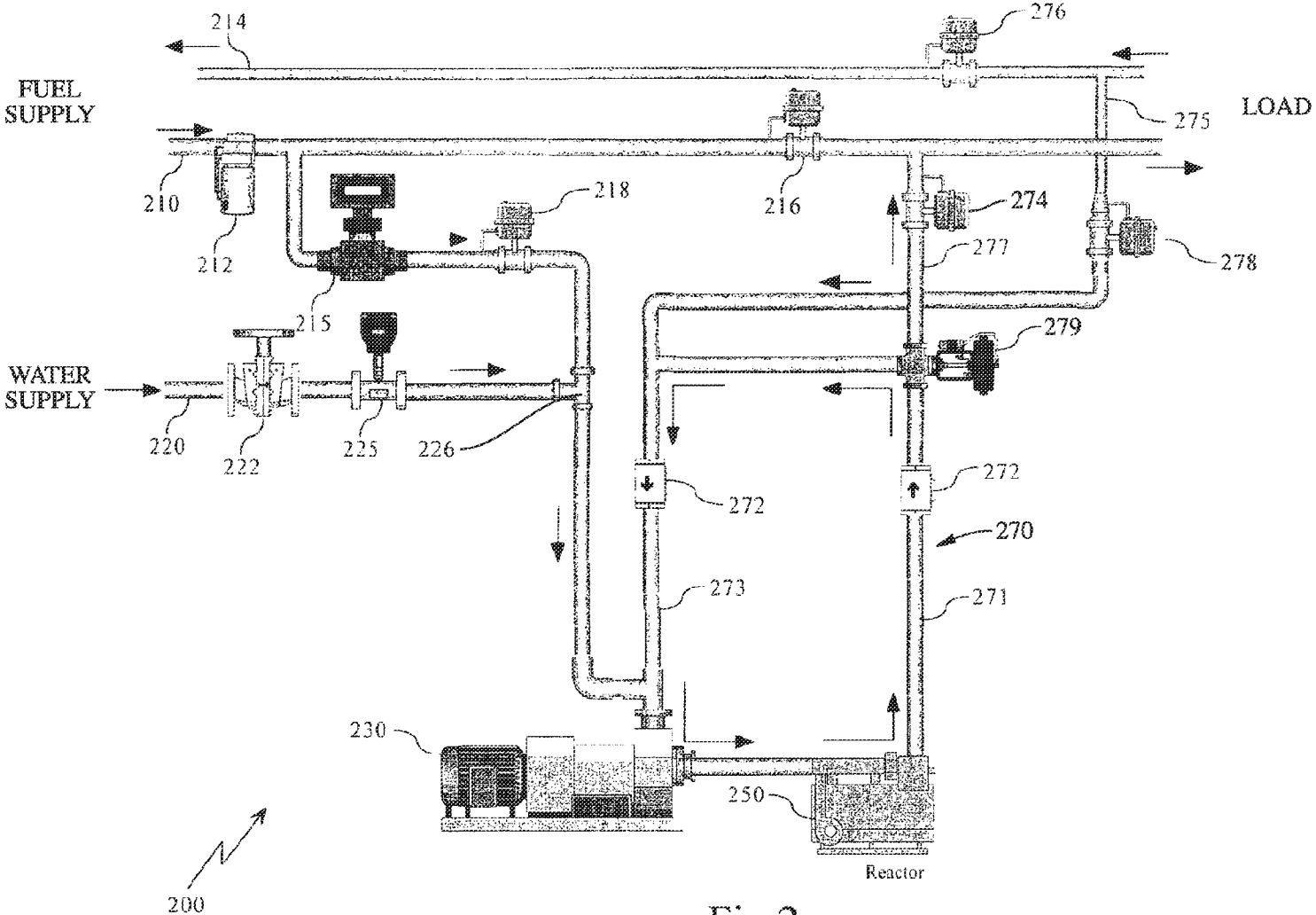
FIG. 2 is a diagram of a fuel-water emulsion system.

In FIG. 2, there is illustrated a schematic diagram of a system 200 comprising a fuel line 210 connected to a fuel supply, a fuel filter 212, a fuel return 214, a fuel metering valve 215, a fuel diverter 216, a fuel inlet valve 218, a water line 220 connected to a water supply, a shut off valve 222, a metering valve 225. The fuel line 210 and the water line 220 may be connected to a mixing junction 226 (e.g., a Tee junction), which may be connected to a pump 230 and a reactor or emulsion apparatus 250, which may be interfaced or connected with the fuel line 210. Additionally, the system 200 may comprise an emulsion circulating loop 270 having a high pressure side 271, a low pressure side 273, one or more static mixers 272 (which may be optional), a pressure bypass valve 279 and an emulsion delivery to combustion valve 274. The system 200 may further comprise an emulsion return line 275 connected to a load (e.g., an engine, a boiler, turbine, furnace or other device), a fuel return emulsion isolation valve 276, an emulsion feed or combustion line 277 connected to the load, and an emulsion return valve 278 connected to the low pressure side 273 of the emulsion circulation loop 270.

When the fuel diverter 216 is closed and the valve 218 is opened, fuel flows through the metering device 215, which may be controlled electronically or simply allowed to flow according to the demands of the load. Water may be introduced via the water line 220 through the shut off valve 222 to the metering device 225. This may be done proportionately. Fuel and water, thus proportioned, may converge at the mixing junction 226 and may be delivered to the pump 230. The pump 230 may pressurize and deliver the fuel and water mixture to the emulsion apparatus 250 where the fuel and water mixture may be constituted as an emulsion. From the emulsion apparatus 250, the emulsion may enter the emulsion circulating loop 270 on the high-pressure side 271 of the emulsion circulating loop 270 and through the static mixer 272 and the pressure bypass valve 279, which may maintain a desired delivery pressure through the emulsion to combustion line 277 via the fuel line 210.

The greater part of the emulsified fuel may be returned by the pressure bypass valve 279 to the low-pressure side 273 of the emulsion circulation loop 270 to the pump 230 to maintain stability of the emulsion in the emulsion circulation loop 270, where the emulsion may be in a constant circulation at a rate that may be greater than the consumption rate of the load. The static mixers 272 may be desirable if the emulsion circulation loop 270 is sufficiently long.

The emulsion that has been consumed may be constantly replenished by the proportioned mixture of fuel and water. The fuel return line 214 may be isolated from the main fuel supply by the fuel return emulsion isolation valve 276, which when closed, may divert returned emulsion back to the low pressure side 273 of the emulsion circulation loop 270 to be maintained along with other unconsumed emulsion.

The system 200 may be installed in parallel with an existing conventional fuel (e.g., a non-emulsified fuel) delivery system in order to facilitate rapid changeover between the emulsion and the existing conventional fuel supply. The reasons for the dual parallel system are to flush the injector pump, the fuel delivery pump, and the fuel line to avoid contamination by water when the emulsion separates during extended shut down, and to avoid interruption of service during maintenance by incorporating certain redundancy. Since the existing conventional fuel delivery system is still intact and the fuel-water emulsion system is in parallel and simply interrupts the existing conventional fuel supply and the return lines, the change over between the fuel-water emulsion and the existing conventional fuel supply may be accomplished easily as follows. During the emulsion mode of operation, the fuel inlet valve 218, the metering valve 222, and the emulsion return valve 278 are open. The fuel diverter valve 216 and the fuel return emulsion isolation valve 276 are closed. During conventional fuel mode, the fuel inlet valve 218, the metering valve 222, and the emulsion return valve 278 are closed and the fuel diverter valve 216 and the fuel return emulsion isolation valve 276 are open. The changeover from conventional fuel to emulsion fuel may be automated by using solenoids or other equivalent automation for controlling the valves 216, 218, 222, 276 and 278, instead of using the manual valves.

The operation of the system 200 is described as follows. As the diverter valve 216 is closed and the fuel inlet valve 218 is opened, fuel flows through metering fuel device 215, which may be controlled electronically or simply allowed to flow according to the demands of the load. Water (e.g., tap water) is introduced through the water line 220 through the shut off valve 222 to the metering valve 225 proportionately. The fuel and water, thus proportioned, converge at fuel and water mixing junction 226 and are delivered to the pump 230 to be pressurized and delivered to the reactor or emulsion apparatus 250, where they are comprise an emulsion. From the emulsion apparatus 250, the emulsion may enter the emulsion circulating loop 270 on high-pressure side 271 and through an optional static mixer 272 and pressure bypass valve 279, which maintains the desired delivery pressure through emulsion to the combustion line 277 via the fuel line 210. The greater part of the emulsified fuel is returned by the pressure bypass valve 279 to the low-pressure side 273 of the emulsion circulating loop 270 to the pump 230 to maintain stability of the emulsion in the emulsion circulating loop 270, where it is in constant circulation at a rate greater than the consumption rate of the load. The static mixers 272 may be desirable if the emulsion circulating loop 270 is sufficiently long.

The emulsion that has been consumed is constantly replenished by the proportional fuel and water supply. The fuel return line 214 is isolated from the fuel supply by the isolation valve 276, which when closed, diverts returned emulsion back to the low pressure side 272 of the emulsion circulating loop 270 to be maintained along with the rest of the unconsumed emulsion.

Figure 3:
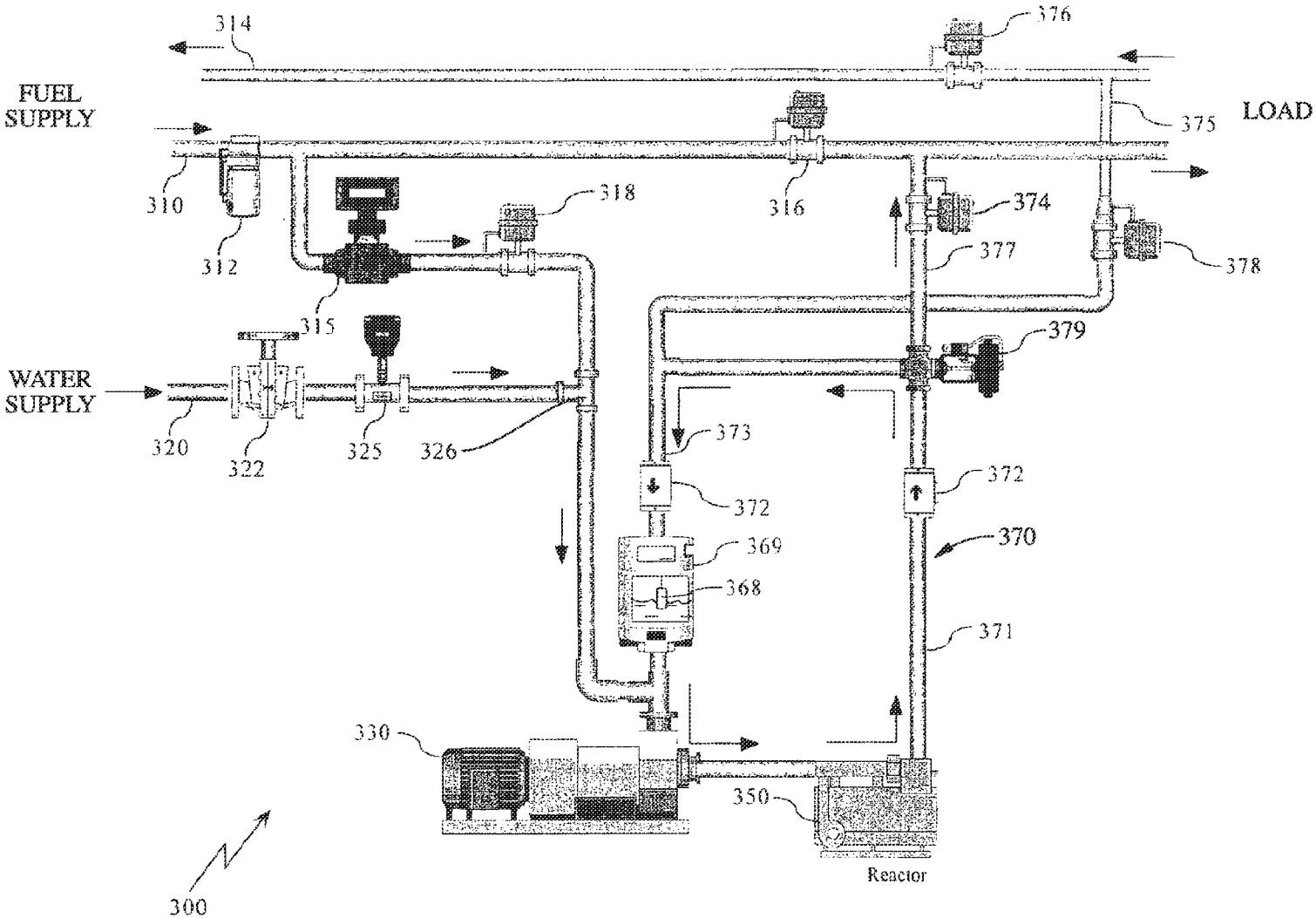
FIG. 3 is a diagram of a fuel-water emulsion system.

In FIG. 3 there is illustrated a schematic diagram of a system 300 of this invention comprising a fuel line 310, a fuel filter 312, a fuel return 314, a fuel metering valve 315, a fuel diverter 316, a fuel inlet valve 318, a having a water line 320 having a shut off valve 322 and a metering valve 325, a fuel water mixing junction 326, a pump 330, a reactor, such as the Hydrosonic emulsion apparatus 350, an existing fuel supply 360, an emulsion circulating loop 370, having a high pressure side 371, a low pressure side 373, one or more static mixers 372, an emulsion delivery to combustion valve 374, an emulsion return line 375 connected to a load, a fuel return emulsion isolation valve 376, an emulsion combustion line 377 connected to the load, and an emulsion return valve 378 connect to the low pressure side 373 of the emulsion circulation loop 370. FIG. 3 also illustrates an open loop 370, which may incorporate a float switch 368 in a production tank 369. The float switch 368 may activate the fuel inlet valve 318 and the shut off valve 322 simultaneously (e.g., by solenoid or other suitable device) in order to replenish the emulsion production tank 369 and emulsion circulating loop 370 at a substantially constant and proportional rate of flow.

Figure 4:
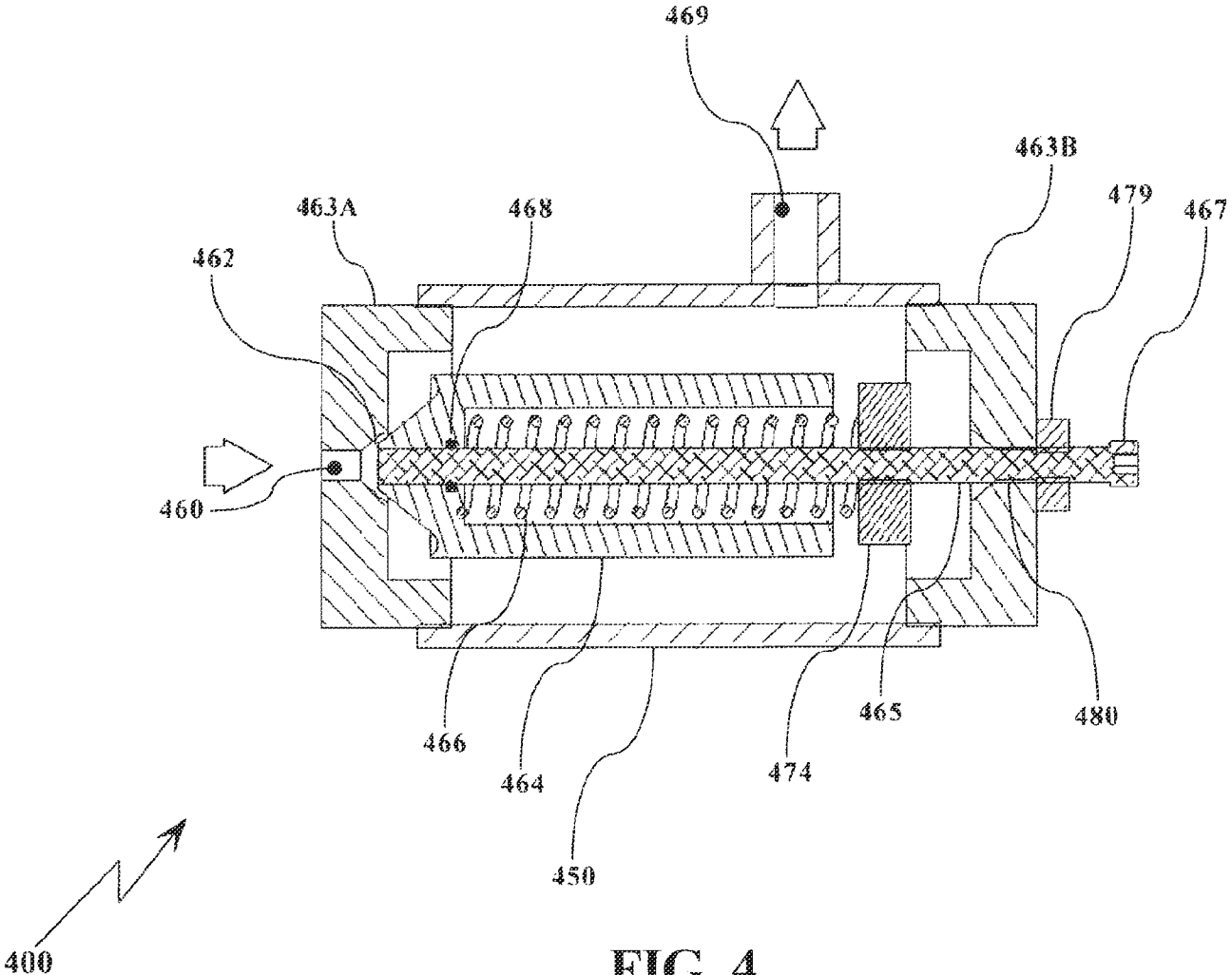
FIG. 4 is a cross-section of a reactor, showing an anvil encased spring.

In FIG. 4, there is illustrated a cross-section of an exemplary reactor or emulsion apparatus 400 suitable for use in the systems 200, 300 described above. The emulsion apparatus 400 may include a housing or casing 450, an inlet 460, an orifice 462, an inlet end-cap 463A, an outlet end-cap 463B, an anvil 464, a threaded or partially threaded shaft 465, a spring 466 encased within the anvil 464, an external adjustment 467, an O-ring seal 468, and an outlet 469. Fuel and water entering the inlet 460 may pass through the orifice 462 and impinge on the anvil 464 to create a substantially constant cavitation along the trailing surface of the anvil 464 sufficient to emulsify the water in the fuel. The emulsion may exit through the outlet 469 directly to the load via the emulsion loop.

The anvil 464 may be attached on the threaded shaft 465, which may or may not carry the O-ring 468. The threaded shaft 465 may allow for adjustment in the compression of the spring 466 by means of a stop-nut 474 threadably engageable with a threaded shaft 480 in an end cap of the casing 450. The shaft 480 is provided with a seal 479. Pressure, amplitude and frequency may be adjusted externally by the external adjustment 467 in order to obtain optimum cavitation.

The anvil 464 does not vibrate on the spring 466 but rather the velocity of the liquid and pressure drop across the face combined with the shape of the anvil 464 creates a substantially constant cavitation, which may roll down the trailing surface of the anvil 464. The spring 466 may maintain a constant pressure between the anvil 464 and inlet orifice 462 and act as a pressure relief in case blockage occurs.

An exemplary process for assembling the reactor or emulsion apparatus 400 may comprise one or more steps selected from the group comprised of providing or machining a substantially cylindrical anvil having an opening near a working surface, adding an O-ring seal inside the opening in the anvil near the working surface, providing or machining a shaft that is at least partially threaded, installing a spring stop or adjustable nut on the threaded shaft, sliding a spring onto the threaded shaft, sliding the anvil over the threaded shaft and the spring, encasing the spring with the anvil, sealing the anvil and shaft with the O-ring, encasing the anvil in a chamber, providing an emulsion outlet port from the chamber, installing a threaded end of the threaded shaft in an outlet side of the chamber, providing or machining a low pressure side outlet end cap with a threaded hole, installing the end cap on the shaft at a low pressure side of the chamber, providing or machining a high pressure side inlet end cap with an inlet orifice machined to match the working surface of the anvil, installing the high pressure side inlet end cap onto the other end or a high pressure side of the chamber, connecting the inlet orifice to a pump discharge, and connecting the outlet port to an emulsion circulating loop.

Figure 5:
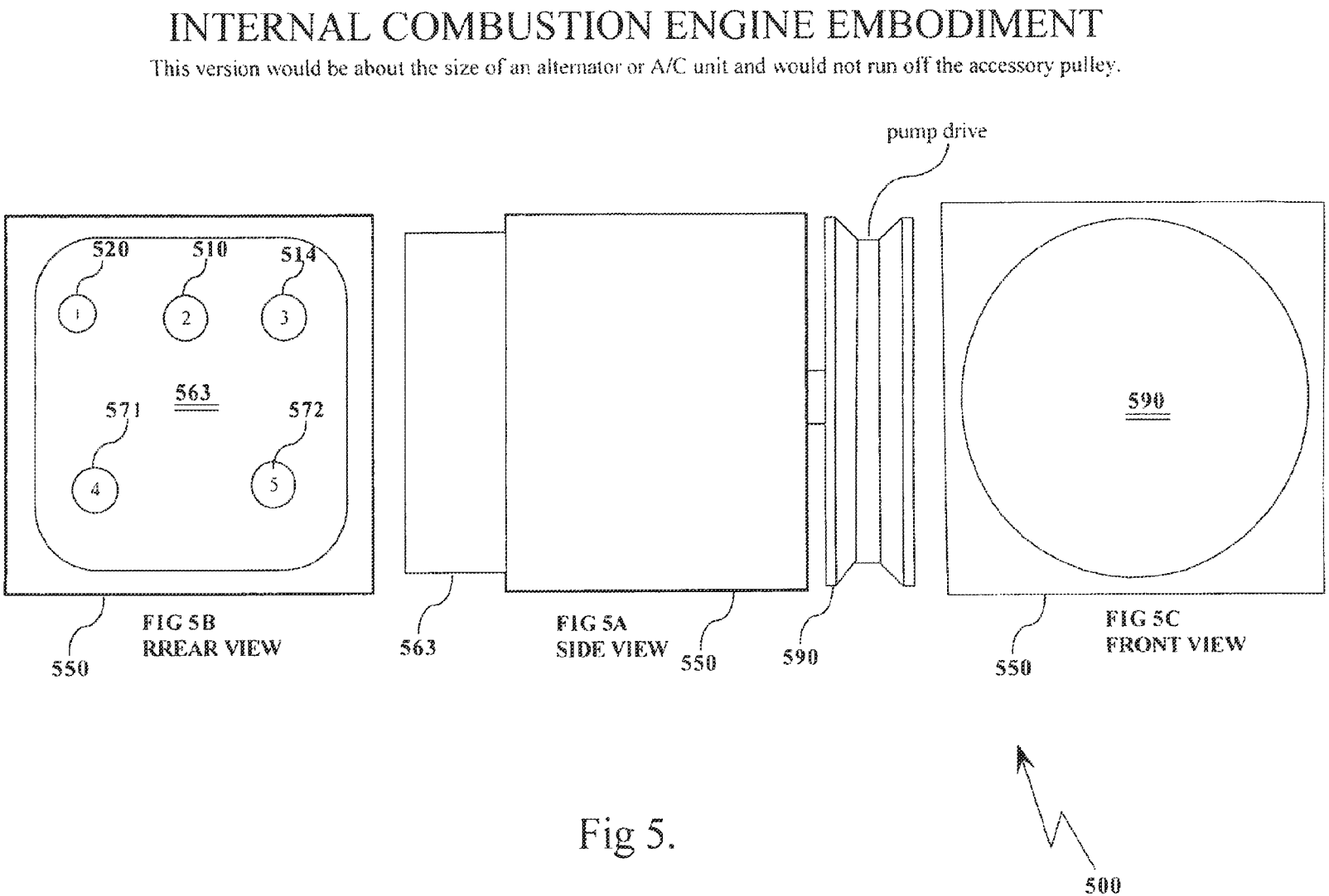
FIG. 5A is a side view of a casing housing a self-contained fuel-water emulsion system.
FIG. 5B is a rear view of the system shown in FIG. 5A, showing inlet and outlet ports for fuel, water and fuel-water emulsion.
FIG. 5C is a front view of the system in FIGS. 5A and 5B, showing a pump drive.

In FIGS. 5A-5C, there is illustrated a compact self-contained emulsion system 500, which may be particularly suitable for smaller emulsion applications. The system 500 may be comprised to a fuel inlet 510, a fuel return 514, a water inlet 520, a housing or casing 550, an emulsion outlet 571, an emulsion return 572, and a pump pulley or other suitable pump drive 590, which may be connected to the load. The pump may be electrical, hydraulic or magnetic. Besides being compact and self-contained, the emulsion system 500 may be powered by the load on which it is installed. The system 500 may combine the pump 230, 330 and the reactor or emulsion apparatus 250, 350 in the housing 550. The emulsion outlet 571 and the emulsion return 572 may respectively form the high pressure side and the low pressure side of an emulsion circulating loop.

Figure 6A:
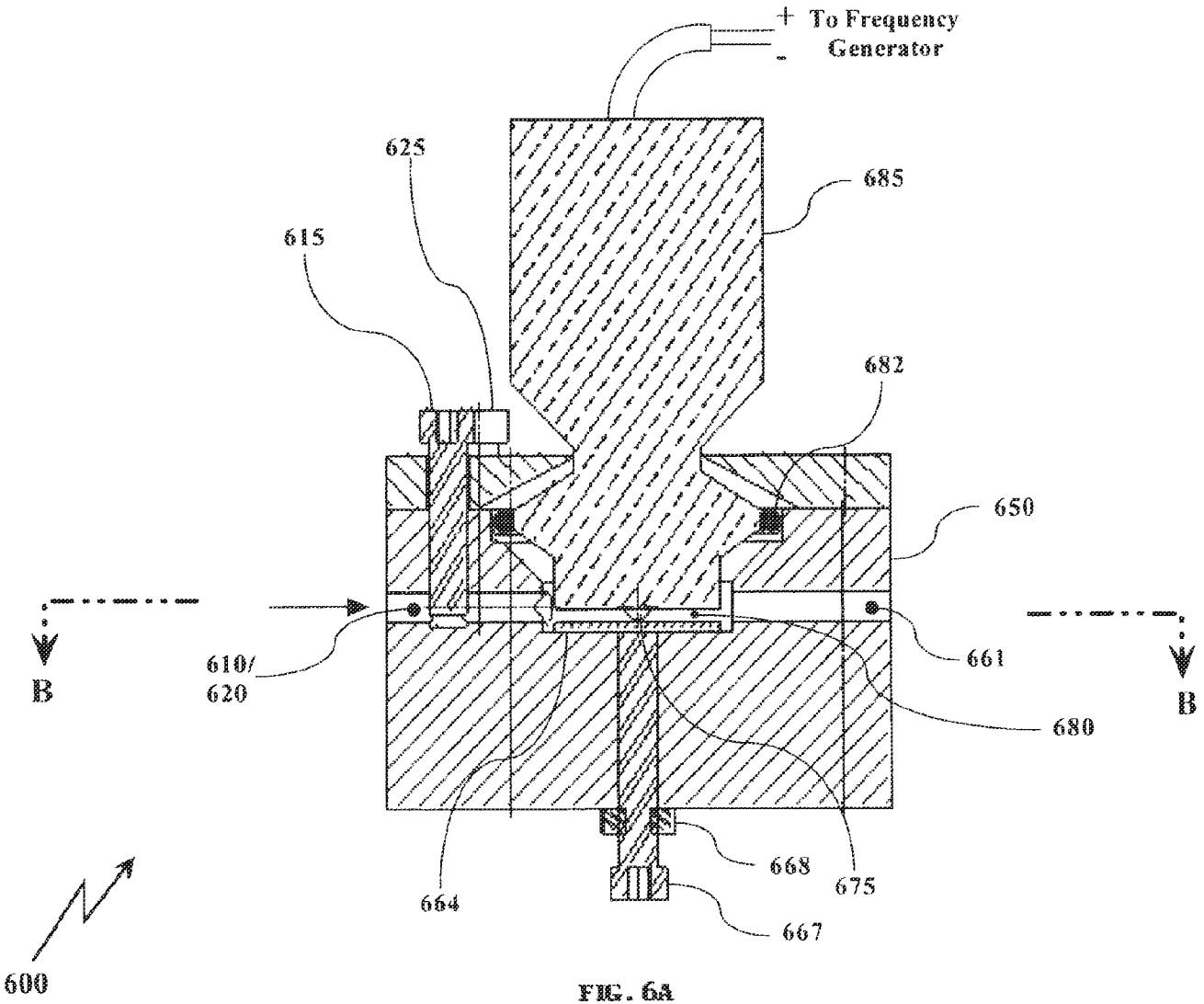
FIG. 6A is a cross-section of an emulsion apparatus with inlet and outlet ports, an adjustable anvil, and a piezo electric drive.
Figure 6B:
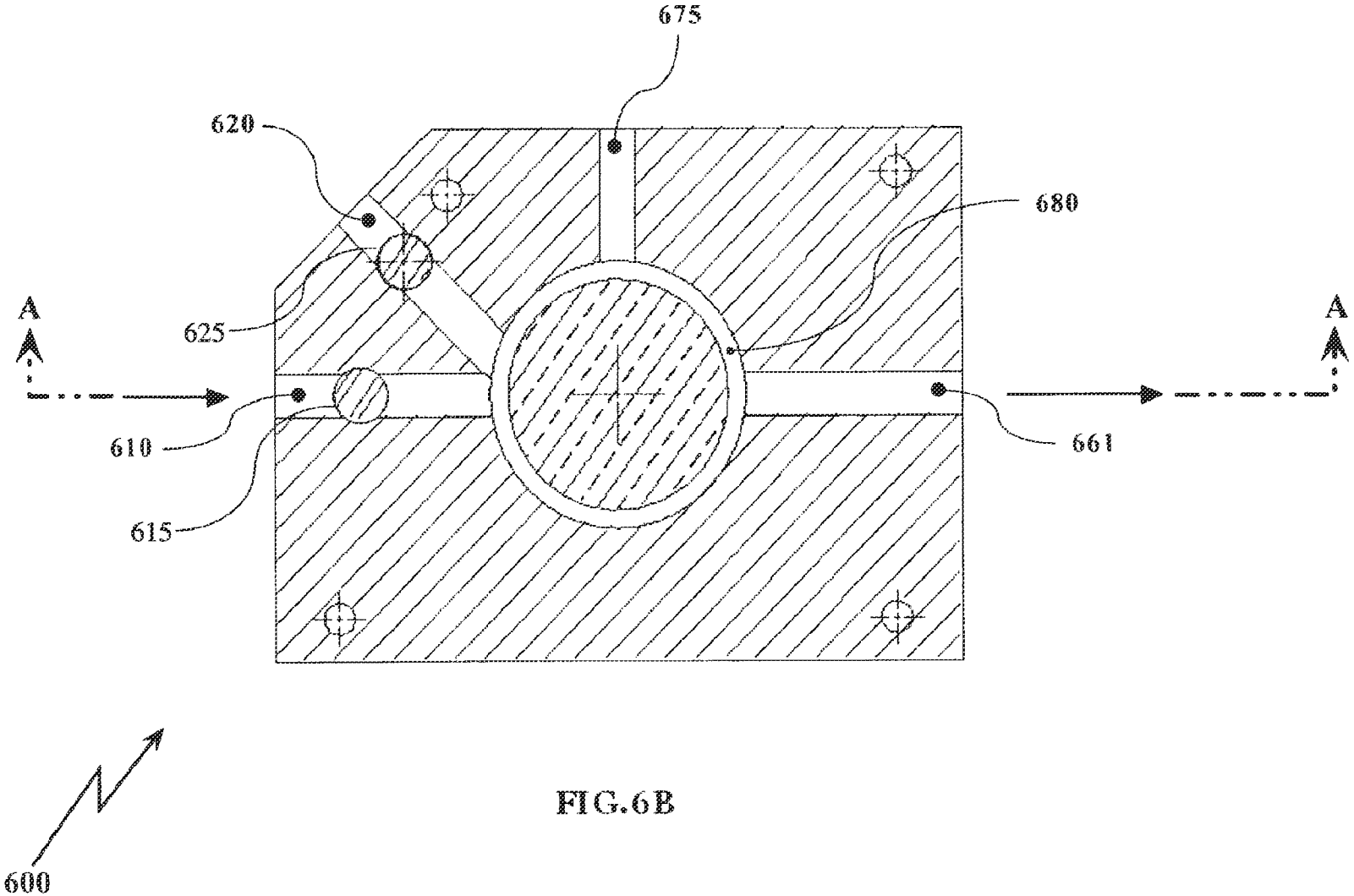
FIG. 6B is a cross-section of the emulsion apparatus taken along lines B-B in FIG. 6A.

In FIGS. 6A-6B, there are illustrated cross-sections of a reactor or emulsion apparatus 600 suitable for use in the systems 200, 300 described above. The apparatus 600 may be in the form of a piezoelectrically driven unit comprising an emulsifying chamber with an adjustable anvil or working surface 664. The apparatus 600 may be comprised of a fuel inlet 610, an adjustable fuel control valve 615, a water inlet 620, an adjustable water control valve 625, a body or casing 650, an emulsion outlet 661, an adjustable anvil or working surface 664, an external anvil adjustment 667, an adjustment lock and seal 668 (e.g., a locking and sealing nut), an emulsion return 675, a mixing or emulsifying chamber 680, an O-ring seal 682, and an ultrasonic piezoelectric probe 685 (e.g., acoustic type probe). This configuration may not require its own pressure pump, as it may be driven by the existing conventional fuel delivery system pump.

In FIG. 6A, there is illustrated a side cross-section of the emulsion apparatus 600 taken along the line A-A in FIG. 6B, showing the fuel return 675, the emulsion outlet 661, and adjustable anvil or working surface 664, the anvil adjustment 667 and adjustment lock and seal 668, which together enable adjustment of the emulsifying chamber 680. The piezoelectrically driven probe 685 may work against the adjustable anvil 664, creating cavitation within the fuel and water sufficient to form a homogenous emulsion. The probe 685 may be sealed within the casing 650 by the O-ring seal 682 at its nodal point.

In FIG. 6B, there is illustrated a top cross-section taken along the line B-B in FIG. 6A, showing the fuel inlet 610 controlled by the adjustable fuel control valve 615 and the water inlet 620 controlled by the adjustable water control valve 625, the emulsion outlet 661 connected to the load, the emulsion return port 675, and the anvil working surface 664.

A process for emulsifying fuel-water in accordance with any one of the system above may comprise one or more steps selected from the group comprised of diverting and metering and controlling a fuel line into an inlet, delivering metering and controlling water into the inlet resulting in proportioned mixture of fuel and water, pumping the proportioned mixture into an emulsion apparatus via a pump, impinging the mixture across an anvil causing cavitation which in turn results in emulsification of water-in-fuel. The method may further comprise the steps of circulating the water-in-fuel emulsion into an emulsion circulating loop in series with the pump and the emulsion apparatus, delivering the water-in-fuel emulsion to a load (e.g., an engine, a boiler, a turbine, furnace, or other device), isolating a fuel supply return from the emulsion circulating loop, re-circulating and reprocessing any unused emulsion through the pump into the emulsion circulating loop in series with the emulsion apparatus.

Figure 7A:
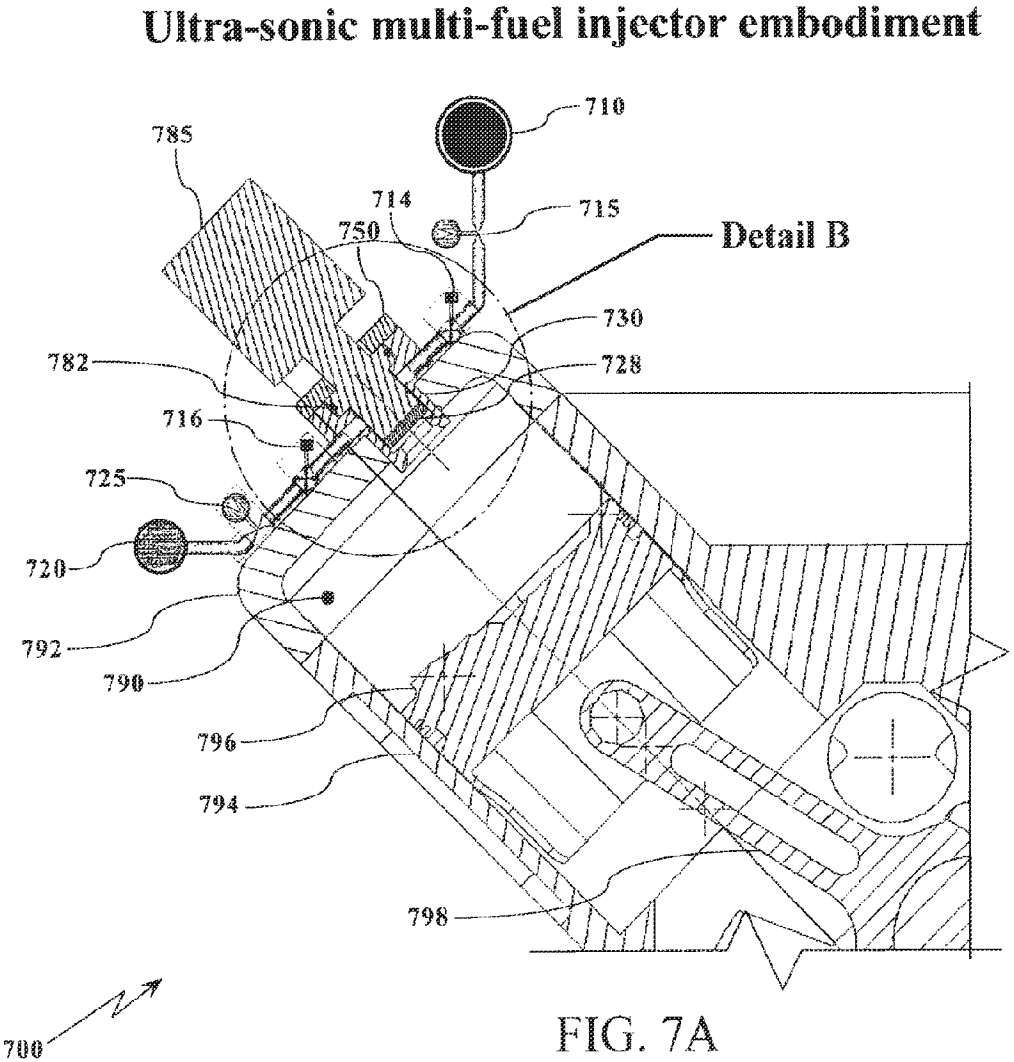
FIG. 7A is cross-section of an injector installed in a cylinder head of an engine.
Figure 7B:
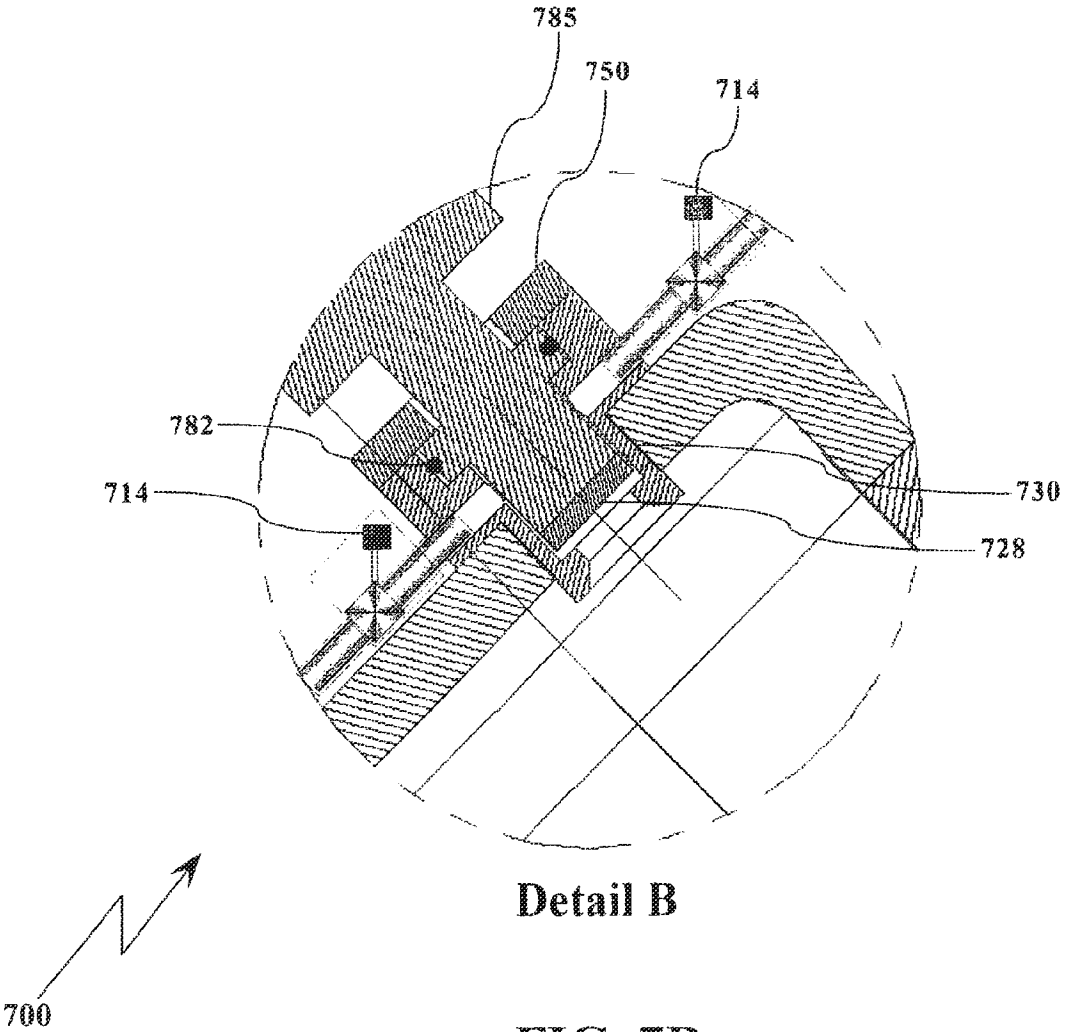
FIG. 7B is an enlarged view of Detail B shown in FIG. 7A.

In FIGS. 7A-7B, there is illustrated a compact self contained piezoelectrically driven fuel-water emulsion injector system 700, which may atomize and deliver emulsified fuel directly to a load, such as an engine combustion chamber 790. The system 700 may be comprised of a fuel inlet 710, a water inlet 720, a piezoelectric metering valve 715, a check valve 716, a piezoelectrically driven ultrasonic injector tip 728, a cup 730 formed, machined or otherwise integrated into a casing, housing or body 750, an O-ring seal 782, and an ultrasonic or piezo-electric crystal stack probe 785. The combustion chamber 790 may be comprised of a cylinder head 792, a cylinder wall 794, a piston 796, and a connecting rod 798. The system 700 may include a configuration for the injection and atomization of fuel at low pressure and varying viscosities and volumes, via the piezo-electrically driven ultrasonic injector tip 728, directly to the combustion chamber 790.

In FIG. 7A, there is illustrated a side view of the injector system 700 installed in relation to the combustion chamber. The piezo electric probe 785 of the injector system 700 vibrates the tip 728. A vibration of approximately 20,000 cycles per second may emulsify the fuel-water mixture delivered through the fuel inlet 710 and the water inlet 720 through the check valve 716 to the cup 730 where the fuel and the water are simultaneously emulsified and atomized directly into the combustion chamber. The cup 730 may be formed in the body 750 and the probe 785 may be sealed within the body 750 by the O-ring 782 at the nodal point of the probe 785. The cup 730 may be formed so as to protrude directly into combustion chamber 790 and the cylinder head 792 in the place of a conventional injector. Due to more complete combustion, less carbon is built up and less wear and tear is experienced by the piston 796 and the cylinder wall 794. The connecting rod 798 is illustrated in the interest of clarity.

In FIG. 7B there is illustrated an enlarged view of Detail B shown in FIG. 7A, showing the cup 730 formed into the injector body 750, although it may be otherwise formed in the injector or the atomizing tip 728.

In diesel engine practice, the high injection pressures may necessitate very precise pumps and in order to atomize the fuel at a very high pressure. The injector system 700 may use low injection pressures and a method of atomization that would allow a wide range of fuel to be used. For instance, distillates, residuals, emulsions and slurries could all be used with equal facility.

Figure 8:
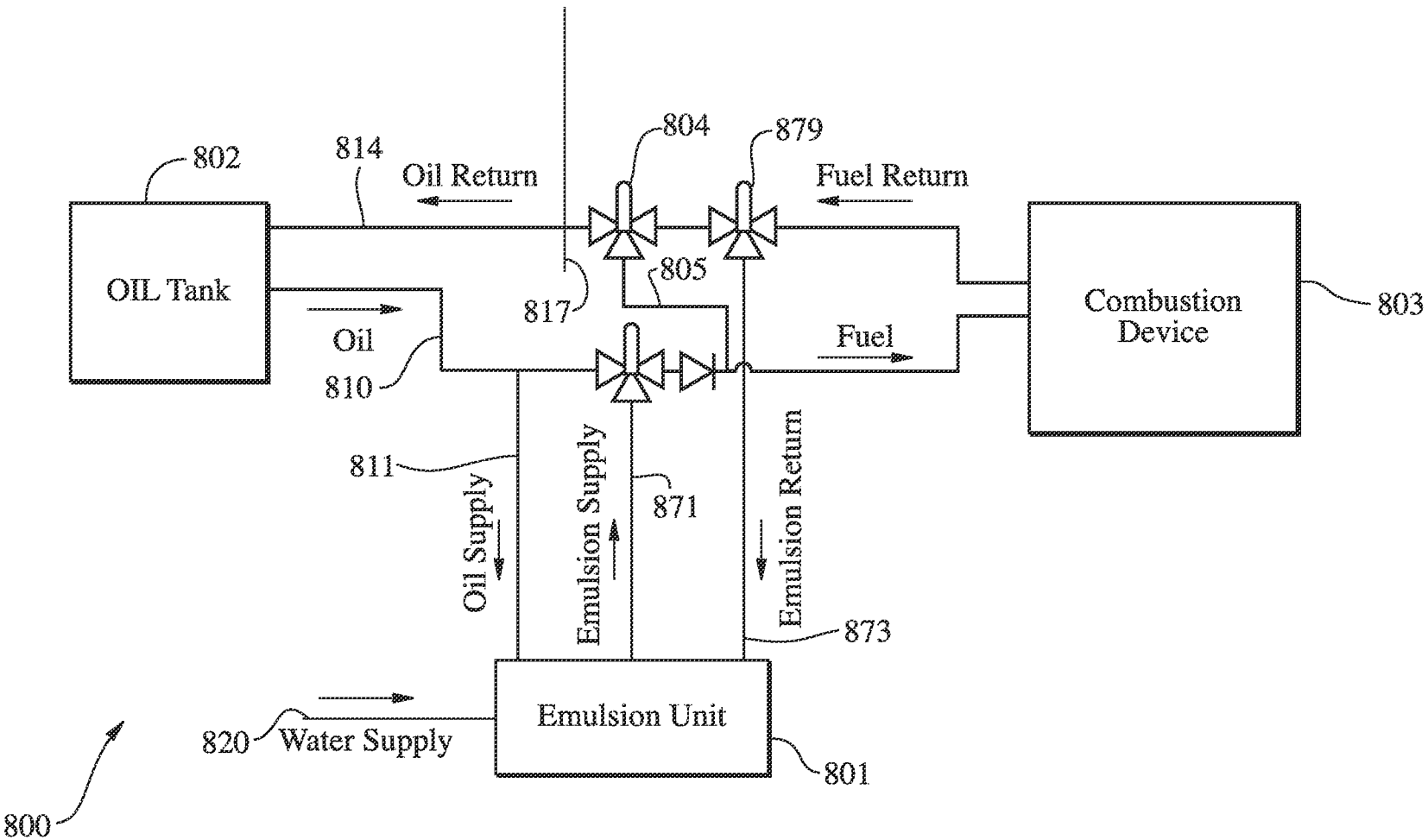
FIG. 8 is a diagram of a fuel-water emulsion system, showing three-way valves and a flush system.

In FIG. 8, there is illustrated an emulsion fuel system 800, similar to system 200, utilizing three-way valves and a secondary bypass 803 in order to avoid any unburned emulsion returning to fuel supply 802. The three-way valves replace the two-way valves 270, 278 in the system 200. The operation of the system 800 may be similar to the system 200, except upon shutdown. When shutdown, the valves 817, 879 are returned to the fuel position. A diverter valve 804 diverts returning emulsion in the fuel to a return line 814.

The system may be controlled automatically, for example, by a simple microprocessor, to the combustion device 803 via line 805, which may be connected to the fuel inlet line 810 for a time sufficient for all emulsion to be consumed by the combustion device 803, at which time the diverter valve 804 may return to the fuel position. This can be accomplished, for example, with the following logic. The load (e.g., the combustion device 803) starts. The emulsion unit 801 starts. The three-way valves 817, 879, 804 are in the fuel position. Load running reactor pressure is achieved. The valves 817, 879, 804 switch to emulsion position, diverting fuel in line 810 through the emulsion unit 801 and isolating the fuel supply 802 from return line 814. At this stage, the load 803 is running on emulsion. To shut down, the emulsion unit 801 shuts down. The three-way valves 817, 879 return to the fuel position. The diverter valve 804 continues to divert the return line 814 back to load via the bypass 805 until all emulsion has been consumed and replaced by pure fuel entering the fuel inlet line 810 directly from fuel supply 802. When all emulsion has been consumed, the diverter valve 804 returns to the fuel position and combustion device 803 shuts down. In hot weather conditions, the microprocessor may sense a predetermined temperature and diverts emulsion return line 873 through a heat exchanger (not shown). If fuel temperature reaches an unacceptable level, either hot or cold, the system reverts to regular fuel operation. In cold weather, system is heated by engines existing cooling system. The microprocessor will not allow the system to operate until a predetermined temperature has been reached.

Figure 9:
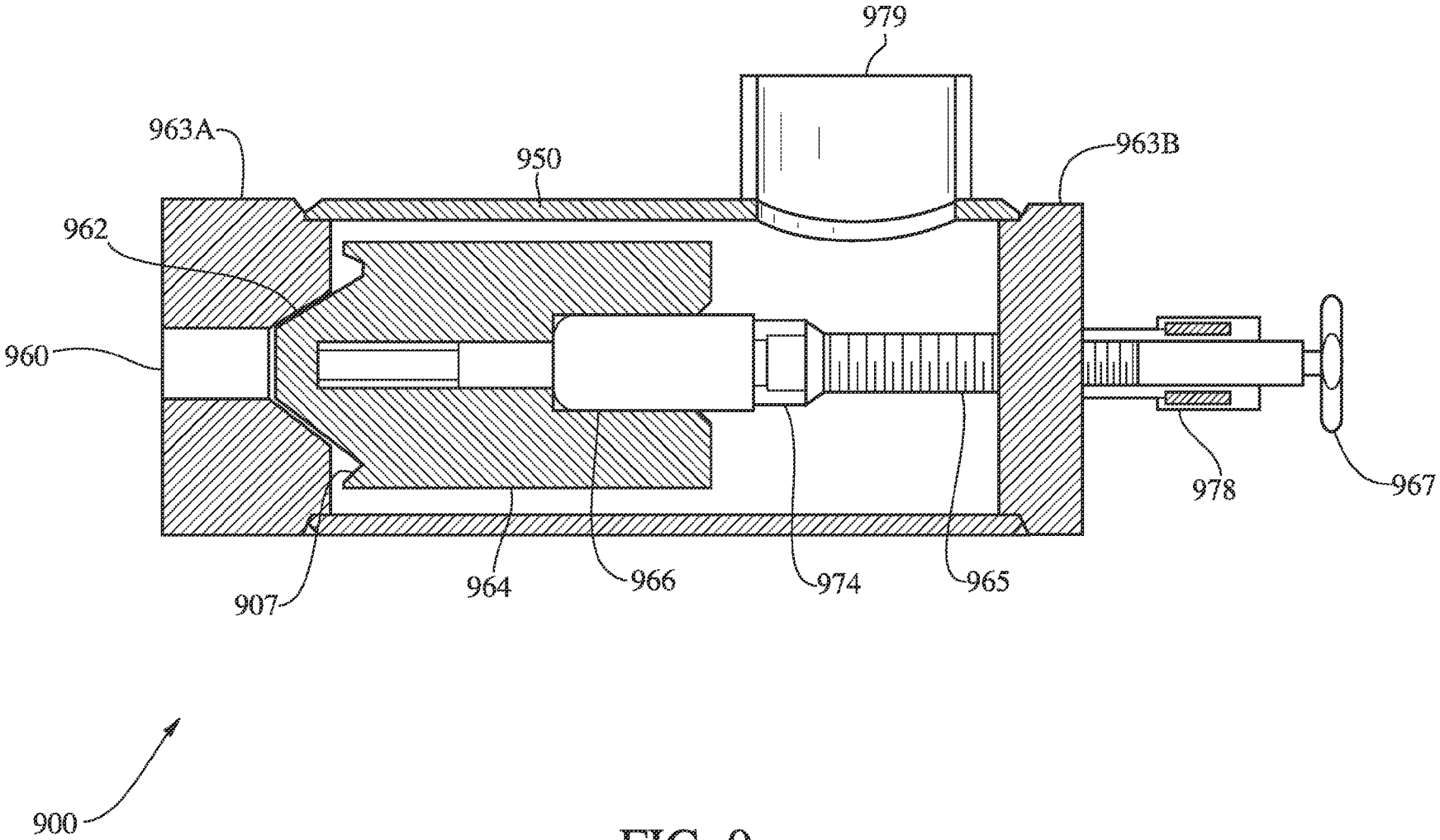
FIG. 9 is a cross-section of a reactor, similar to that shown in FIG. 4, without an O-ring or spring.

In FIG. 9, there is illustrated a cross-section of a reactor or emulsion apparatus 900 similar to the reactor 400, without a spring and including a closed anvil 964, eliminating the need for an O-ring seal, which may be used in the systems 200, 300, 800, as well as other processing applications. The reactor 900 may include a tubular housing or casing 950, an inlet 960, an orifice 962, an inlet end cap 963A, an outlet end cap 963B, a stationary anvil 964 with a cone-shaped end creating orifice 962, and a lip 967. The anvil 964 may be supported by a threaded rod 965. The orifice 962 may be adjusted by means of external adjustment 967. The seal 978 may prevent leakage between threaded rod 965 and end cap 963B. One or more miscible or immiscible liquids or solids may pass through the orifice 962. The orifice 962 may cone-shaped with an angle corresponding to the angle of a cone-shaped anvil 964. The liquids or solids accelerate along the anvil 964 and around the lip 967. This may create a pressure drop, which may create cavitation along trailing surface of the anvil 964 sufficient to create an emulsion or breakdown of solids within the liquid. The area of the space between the anvil 964 and the casing 950 may be at least as great as the area of the diameter of outlet 979. Once processed, material may exit the reactor through the outlet 979.

Figure 10:
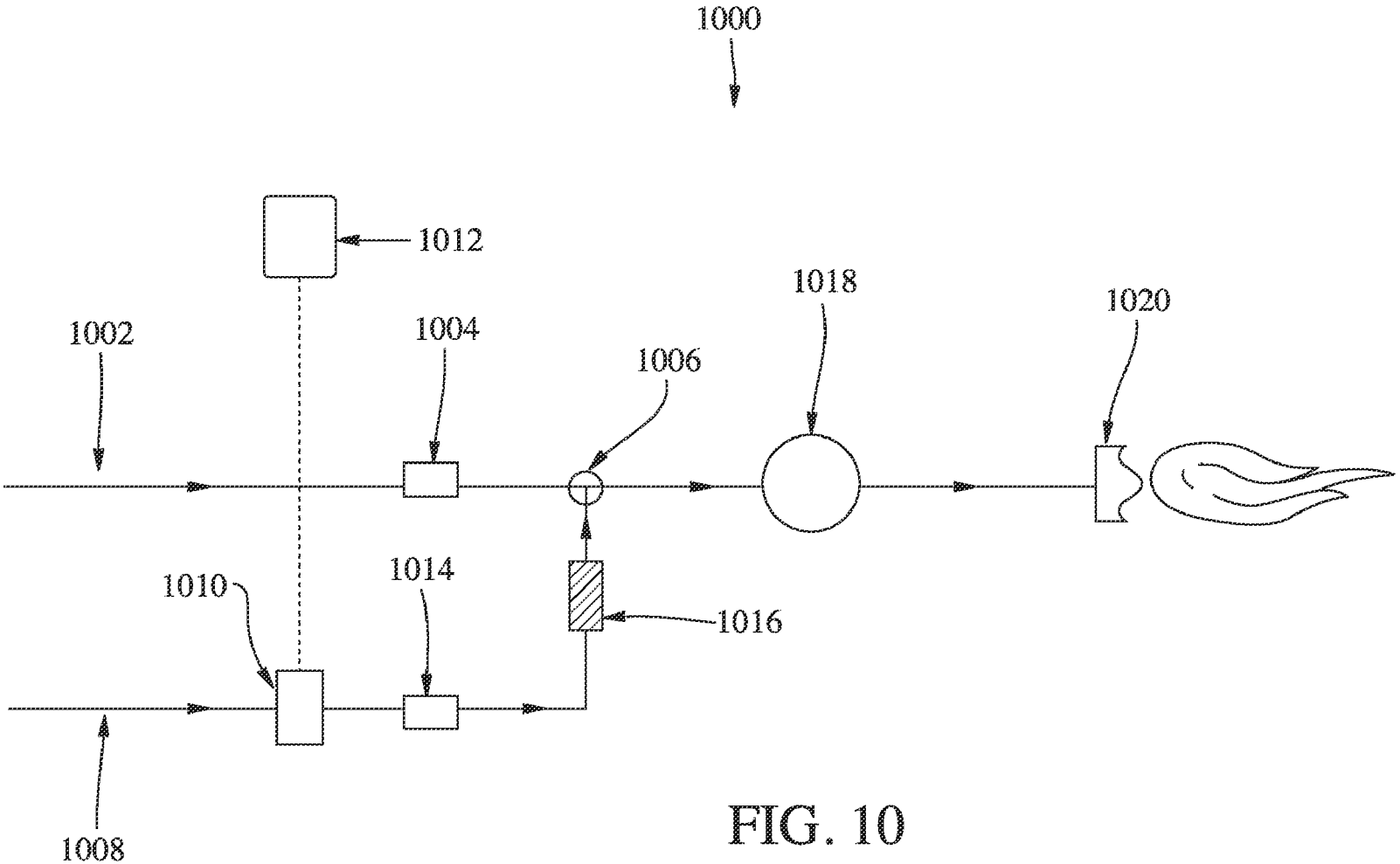

FIG. 10 illustrates an emulsion fuel conversion 1000 that may be used on smaller combustion devices. A standard fuel, such as heating fuel or biodiesel, may flow through an existing fuel inlet line 1002, which is fitted with check valve 1004. The fuel may be mixed with water at mixing tee 1006. The water may be introduced by means of line 1008 controlled by a solenoid valve 1010, which may be normally closed, and check valve or back flow preventer 1014. The water flow may be controlled by a fixed orifice or Dole type flow control valve 1016. The size of the control valve 1016 may be determined by the capacity of the combustion device. For example, if an oil burner has a one gallon per hour nozzle and 15% emulsion is required, the control valve 1016 may be sized at 0.15 gallons per hour. The water thus metered may be introduced to the fuel stream at the mixing tee 1006. The proportioned fuel-water mixture may flow into an existing pressure pump 1018. If the flow rate of the pressure pump 1018 is greater than the burn rate of the combustion device, the mixture may be re-circulated many times. A shearing effect emulsifies the mixture. Emulsified and pressurized, the emulsion fuel flows to the burner nozzle or injector 1020. The shearing effect and pressure drop across the nozzle 1020 may serve to further reduce particle size and evenly distribute the water particles throughout the emulsion, whereupon it may be immediately combusted. The system 1000 may utilize a control 1012, which may be connected to existing combustion device on/off controls. This may automatically open the solenoid valve 1010 after the combustion device starts and close solenoid valve 1010 a short time before combustion device stops.

The ultrasonic probe 785, in which a booster and a velocity transformer are engineered to withstand the compression pressure of a diesel engine, will atomize the fuel ultrasonically as it passes its tip, since the pressures of the fuel and the pressures in the combustion chamber are at or near equilibrium at the top of the stroke. The fine atomization and precise control afforded by this device should improve efficiency and reduce emissions.

A process for emulsifying water-in-fuel may comprise one or more steps selected from the group comprised of assembling an emulsion chamber with plurality of inlet and outlet ports, diverting fuel from an existing fuel supply line to the inlet port of the emulsion chamber, introducing water from 5% to 30% volume with respect the fuel volume to the inlet port, cavitating the mixture in the emulsion chamber resulting in emulsification, circulating the emulsion in an emulsion circulating loop around the emulsion chamber, delivering a smaller part of the emulsion to a load on demand, re-circulating excess emulsion in the emulsion circulating loop at a rate greater than maximum demands of the load, replenishing the emulsion in the emulsion circulating loop from the emulsion chamber, and replenishing fuel and water supply at the inlet ports.

The process for producing a fuel may comprise the step of delivering water and oil (e.g., hydrocarbon fuels, biofuels, or other fuels) to an apparatus in the form of a reactor or emulsion apparatus, which may create sufficient substantially constant cavitation to create an emulsion without the use of chemical surfactants or emulsifiers. The emulsified fuel may be delivered directly to the burner or an injector pump, which may draw on demand, with excess emulsified fuel re-circulating back through the apparatus in a constant circulating loop at a greater rate than the maximum requirements of the load or application. The apparatus for creating cavitation may be comprised of a reactor or emulsion apparatus in which fuel and water enter an orifice and impinge on a specially shaped, spring loaded anvil, which encloses the spring so as not to interrupt the flow of cavitation bubbles.

The emulsified fuel may be sent to a storage tank, which may feed the load (e.g., an engine, a boiler, a turbine, furnace, or other device). If supply exceeds demand, the emulsified fuel may be re-circulated through the apparatus at reduced pressure and flow. Due to the thixotropic nature of the emulsion and the cavitation effect of the apparatus, this process may also be used to reduce the viscosity of fuels in order to make the fuels more mobile.

The apparatus may include a structure to agitate the fuel-water to create cavitation, which may include a chamber comprising two adjustable angled flat blades, which converge to form a flat aperture. Pressurized fuel-water may cavitate along these blades due to the shape of the blades, the flow of the fuel-water through a flat aperture, and the impingement of the fuel-water on to a third adjustable flat blade, causing all three blades to vibrate, causing cavitation within the mixture to form a finely dispersed stable emulsion with reduced viscosity.

The systems, apparatus and methods described above may produce an ultra fine droplet size that has a less dramatic an effect on the secondary atomization or micro explosions that may occur when the water turns to super heated steam in the combustion chamber. Water droplets of ten plus microns inside a film of oil or other fuel are more effective in causing micro explosions or scattering and re-atomizing the fuel. This presents more fuel surface area for a more complete combustion, resulting in less unburned fuel which translates to reduced emissions and fuel consumption.

These simple onboard or onsite apparatus may assure a constant supply of substantially uniform emulsion at the desired water and fuel ratio, water dispersion, or droplet size to the load (e.g., an engine, a boiler, a turbine, furnace, or other device), which may otherwise be unstable but for the emulsion maintained in the circulating loop.

It should be appreciated that the shape and size of the apparatus or system may be modified, as may the shape and size of the various components, including the anvil. Additionally, the pressure across the anvil may be varied. Further, the apparatus may be in the form of a Hydrosonic or ultrasonic device, a colloid mill, a cavitating valve, a liquid whistle, or other suitable device that may produce cavitation or otherwise suitably change in character in a fuel-water mixture.

The apparatus, system and process may be safe, secure, simple, elegant, sleek and aesthetically pleasing. They may be easy to manufacture, install, use or operate, and service or maintain. They may be efficient, affordable and cost effective. They may be long lasting and durable, and provide rugged reliability. They may have a low high mean time between failures. They may be easy to store and ship for portable applications. They may provide an alternative to costly exhaust side emissions management The apparatus, system and process may be universal in application for providing energy for all types of loads and incorporated into all types of loads, including engines, boilers, turbine, furnaces, and other devices. They may be easily scaled up or down in size. The emulsion may be operate or delivered to multiple loads.

The apparatus, system and process may be user friendly so as to be suitable for a novice as well as sophisticated expert user. They may be intuitive and user transparent, such that it requires no additional training.

The apparatus, system and process may mainly standard off the shelf modular parts and other components. They may be integrated in-line as an OEM apparatus, system or process, or as an aftermarket or retrofit apparatus, system or process into the load environment. They may utilize existing parts, controls, modules and operating procedures, obviating any further training of the operators. They may be packaged as an integrated unobtrusive compact modular apparatus, system and method. They may be made of modular components. They may be manufactured and maintained with ease. They may be user friendly and use mainly standard off the shelf modular parts and other components.

The apparatus, system and process may readily facilitate switching back and forth between a conventional fuel delivery system and an emulsified fuel system automatically so as to be operator transparent. Additionally, they may facilitate an automatic switch in the case of a system failure. They may provide easy interruption free installation without substantially modifying the existing load with little down time and even zero down time in the case of redundant conventional fuel delivery systems.

Start-up, shutdown and emulsion flush cycles may be automated and also controlled by management system or computer of the load, or by simple timers, or by other suitable devices. Water and fuel ratios may be controlled by the management system or computer of the load (e.g., an engine, boiler, turbine, furnace and other device), or by real time emissions monitoring devices.

The emulsion system pump may replace the existing or conventional fuel delivery system pump, which may function as redundant or back up pump. Alternatively, pressure to create cavitation may be achieved by existing the fuel delivery system pump or the injector pump. In certain applications, the fuel and water may be emulsified by the fuel delivery system pump, or by an atomization device, once delivered by the emulsion circulating loop.

The apparatus, system and process may provide uniform emulsification. They may provide emulsified fuel in real time on demand. They may circulate emulsified fuel in a loop at a rate greater or far greater (e.g., an order of magnitude) than the demands of the load.

All types of fuels, including hydrocarbon fuels (e.g., fossil fuels), biofuels, and other fuels, any be emulsified by the apparatus, systems and processes. The apparatus, system and process may have the ability to adjust water ratio for special applications as balance between economy and environment. The fuel type or viscosity may be changed by introducing an atom, molecule or other equivalent particle at the center of the water droplet. Other materials, such as powdered limestone, may be added to an aqueous phase to serve as a vehicle for sulfur, which may then be captured on the exhaust side. They may reduce fuel viscosity, for example, in the case of hydrocarbons, Bitumen.

The apparatus, system and process may use little additional energy when compared to the potential savings. They may reduce emissions, reduce fuel consumption of the load, and otherwise be environmentally friendly. They may reduce maintenance and hence reduce life cycle cost of the load.

The apparatus, system and process may meet all federal, state, local and other private standards guidelines, regulations, and recommendations with respect to safety, environment, and energy consumption. They may be reliable, such that risk of failure is minimized, require little or no maintenance, and have a low mean time between failures. They may be long lasting made from durable material. They may be physically safe in a normal environment as well as in accidental situations.

Features and functions of the electronics and controls associated with the apparatus, systems or processes may also be modified. The apparatus, system and process may have multiple uses in a wide range of situations and circumstances. They may easily adaptable for other uses. For example, they may be adapted for use in applications, such as emulsifying food, paint, cosmetics, and the like.

Other changes, such as aesthetics and substitution of newer materials, as they become available, which substantially perform the same function in substantially the same manner with substantially the same result without deviating from the spirit of the invention may be made.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A real time in-line water-in-fuel emulsion system comprising:

a reactor device;

a fuel intake connected to said reactor device;

a water intake connected to said reactor device;

a pump connected to said reactor device; and a circulating emulsion reprocessing inline loop connected to said pump and feeding a load as needed in real time, wherein said reactor device comprises a non-vibrating anvil shaped to create cavitation sufficient to emulsify water-in-fuel from said water intake and said fuel intake.

2. The real time in-line water-in-fuel emulsion system of claim 1 wherein said circulating loop circulates at a flow rate greater than the maximum load requirements.

3. The real time in-line Water-in-fuel Emulsion System of claim 1 adapted for a mobile application and installed on-board a watercraft.

4. The real time in-line water-in-fuel emulsion system of claim 1 wherein said water-in-fuel emulsion includes a carbon particle at the center thereof.

5. The real time in-line water-in-fuel emulsion system of claim 1 wherein said load comprises is at least one load selected from a group consisting of boiler, diesel engine, internal combustion engine and turbine.

6. The real time in-line water-in-fuel emulsion system of claim 1 wherein said cavitation is constant.

7. The real time in-line water-in-fuel emulsion system of claim 1 wherein said cavitation is along an outside edge of said anvil.

8. The real time in-line water-in-fuel emulsion system of claim 1 wherein said cavitation is along a trailing surface of said anvil.

9. The real time in-line water-in-fuel emulsion system of claim 1 wherein said reactor device comprises a cylindrical chamber with an inlet orifice for fuel and water, which pass through said orifice and impinge said anvil at a pressure and velocity to create said cavitation.

10. The real time in-line water-in-fuel emulsion system of claim 9 wherein said cavitation is created within liquid around an outside edge and trailing surface of said anvil.

11. The real time in-line water-in-fuel emulsion system of claim 1 wherein said circulating loop is isolated from the fuel supply.

12. The real time in-line water-in-fuel emulsion system of claim 1 wherein a ratio of the water and the fuel is adjustable.

13. The real time in-line water-in-fuel emulsion system of claim 1 wherein dispersion of water in fuel is variable to suit the installation or application.

14. The real time in-line water-in-fuel emulsion system of claim 1 further comprising means for switching back and forth between emulsion and existing fuel supply to flush the load with pure fuel before shut down.

15. The real time in-line water-in-fuel emulsion system of claim 1 wherein said circulating loop circulating emulsified product intersects means of atomization as close as possible to the point of combustion in order to facilitate a quick flush with pure fuel to avoid water separation in pumps and lines.

16. The real time in-line water-in-fuel emulsion system of claim 1 wherein said anvil is a stationary anvil with a cone-shaped end, which at least partially defines an orifice, and an annular recess at a base of the cone-shaped end defined between the base of the cone-shaped end and an outer lip, wherein water from said water intake and fuel from said fuel intake passing through said orifice accelerates along said cone-shaped anvil and around said lip, creating said cavitation to emulsify said water-in-fuel.

* * * * *